United States Patent [19]

Leifeld et al.

[11] Patent Number: 4,914,787

[45] Date of Patent: Apr. 10, 1990

[54] METHOD OF AND APPARATUS FOR BLENDING TEXTILE FIBERS

[75] Inventors: Ferdinand Leifeld, Kempen; Karl Röttgering, Wegberg-Dalheim, both of Fed. Rep. of Germany

[73] Assignee: Trützschler GmbH & Co. KG, Monchen-Gladbach, Fed. Rep. of Germany

[21] Appl. No.: 278,473

[22] Filed: Dec. 1, 1988

[30] Foreign Application Priority Data

Dec. 1, 1987 [DE] Fed. Rep. of Germany ..... 3740616

[51] Int. Cl.[4] ..... D01G 13/00

[52] U.S. Cl. ..... 19/145

[58] Field of Search ..... 19/145, 145.3, 145.5, 19/145.7, 296, 302, 304

[56] References Cited

U.S. PATENT DOCUMENTS 3,997,942 12/1976 Buck, Jr. et al. ..... 19/296
4,531,262 7/1985 Reiche ..... 19/145.5

FOREIGN PATENT DOCUMENTS 34104 4/1908 Austria ..... 19/145.5
1175315 12/1969 United Kingdom ..... 19/302

*Primary Examiner*—Werner H. Schroeder
*Assistant Examiner*—D. Price
*Attorney, Agent, or Firm*—Spencer & Frank

[57] ABSTRACT

A textile fiber blending apparatus comprises a blending conveyor having an upstream end and a downstream end as viewed in its direction of travel; a waste fiber feeder having a discharge end for discharging waste fiber on the upstream end of the blending conveyor for forming a waste-fiber layer thereon; and a useful-fiber mixer having a plurality of fiber hoppers, each having a top portion, a bottom portion and a discharge opening at the bottom portion. The discharge openings are arranged above the blending conveyor, downstream of the discharge end of the waste fiber feeder and each depositing, in succession, a layer of useful fibers, whereby on the conveyor a fiber layer stack is formed, constituted by a lowermost waste fiber layer deposited by the waste-fiber feeder and a plurality of superposed useful-fiber layers. The apparatus further has a fiber removing device arranged at the downstream end of the blending conveyor for receiving the fiber layer stack therefrom. The fiber removing device has a mechanism for ablating the fiber layer stack by removing fibers simultaneously from all the fiber layers.

16 Claims, 2 Drawing Sheets

METHOD OF AND APPARATUS FOR BLENDING TEXTILE FIBERS

BACKGROUND OF THE INVENTION

This invention relates to a method and apparatus for blending (mixing) textile fibers. The apparatus is of the type which has a plurality of serially arranged mixing hoppers or the like, charged in sequence with useful (good) fibers at the top by means of a fiber conveying arrangement. The useful fibers are discharged from the bottom of each hopper onto a common blending conveyor.

According to a known method, the useful fibers are admitted to a cleaner and therefrom they are advanced to a blender, such as a multi-hopper, multiple blending apparatus. Upstream of the cleaner, small quantities of cleaned waste fibers are added to the useful (good) fibers. It is a disadvantage of this known process that the waste fibers are not admitted in a uniformly metered manner, so that irregularities in the blend and thus in the yarn prepared from the fiber blend may appear. Such irregularities disadvantageously manifest themselves, for example, as discolorations.

SUMMARY OF THE INVENTION

It is an object of the invention to provide an improved method and apparatus of the above-outlined type which eliminates the discussed disadvantages and which ensures a better dosed and more uniform mixing of waste fibers to the useful fibers and thus ensures an improved yarn quality.

This object and others to become apparent as the specification progresses, are accomplished by the invention, according to which, briefly stated, a layer of waste fiber is deposited on the blending conveyor and the useful fibers are placed on the top of the waste fiber layer from the fiber hoppers. The superposed layers are advanced to an ablating apparatus which removes the fibers simultaneously from all the layers.

Thus, according to the invention, the useful fibers fall from the mixing hoppers on the waste fiber layer previously deposited on the blending conveyor. In this manner, a favorable, uniform addition of the small waste quantities to the large useful fiber quantities discharged from the mixer is ensured. This layer stack is dissolved in the down-stream-located opener or cleaner, resulting in a superior blend. By virtue of the method according to the invention, waste fibers are admitted to the useful fibers in an advantageous, metered manner and in a predetermined constant ratio to the larger fiber quantity. It is thus feasible to add small quantities of waste fibers to large quantities of useful fibers continuously or intermittently before they are mixed to one another in an ideal manner in the downstream-arranged opener or cleaner. The solution is simple and economical.

The apparatus according to the invention has a plurality of serially arranged fiber hoppers sequentially charged with useful fibers from above. A common blending conveyor moves past the bottom discharge opening of each fiber hopper, whereby superposed layers of good fiber are formed. A waste fiber feeder is arranged upstream of the blending conveyor to deposit a waste fiber layer thereon prior to the deposition of the layers of useful fiber. The layer stack formed by the bottom waste fiber layer and several useful fiber layers superposed thereon is advanced to a device which removes the fibers simultaneously from all the layers.

Preferably, the waste fiber feeding apparatus is used in conjunction with a four-fold mixer and expediently comprises a standby table, an opener and a removal conveyor belt which deposits the waste fiber on the upstream end of the common blending belt of the four-fold mixer. The waste fibers to be added to the useful fibers may be useful fiber waste or prepared (recycled) material. The opening roller of the waste fiber feeder throws the opened fiber tufts onto a waste fiber supply conveyor which preferably is separated by a roller from the blending belt. Expediently, the roller is supported by pivot arms to permit a raising and lowering thereof by the waste fiber material passing thereunder. Advantageously, the roller lies by its own weight on the waste fiber layer and compresses the loose tuft mass to form a waste fiber lap. Forming a lap from the loosely deposited fiber mass is advantageous, in that in the fiber lap the fiber tufts have a sufficient cohesion to permit a positive advancement of the material and to prevent the material from being stirred up in a random manner and mixed to the useful fibers on the blending belt by the air currents generated by the downstream-located opening rollers. The fiber tufts constituting the useful fibers fall from the mixing hoppers onto the waste fiber lap. In this manner, there is achieved an advantageous association of the small waste fiber quantities with the large useful fiber quantities discharged by the mixer.

Preferably, the pivotal position (excursion) of the compressing (densifying) roller is continuously monitored by path sensors situated at the opposite roller ends. The position signal may be utilized as a signal representing the thickness of the waste fiber lap and by empirical conversion may also be used as a signal representing the quantities of the added waste fiber. Advantageously, the feed roller of the waste fiber opener is, as a function of the lap thickness, rotated slower or faster by means of a regulator. In this manner the waste fiber quantity feed may be held at least approximately at a constant value. The base rpm of the waste fiber opening roller may be made a function of the speed of the blending belt which, in turn, depends from the speed of the waste fiber feed belt and the intake speed of the opener or cleaner arranged downstream of the four-fold mixer. Thus, by increasing or decreasing the velocity of the conveyor belts and rollers the mixture ratios may be maintained constant.

DESCRIPTION OF THE PREFERRED EMBODIMENT

Figure 1:
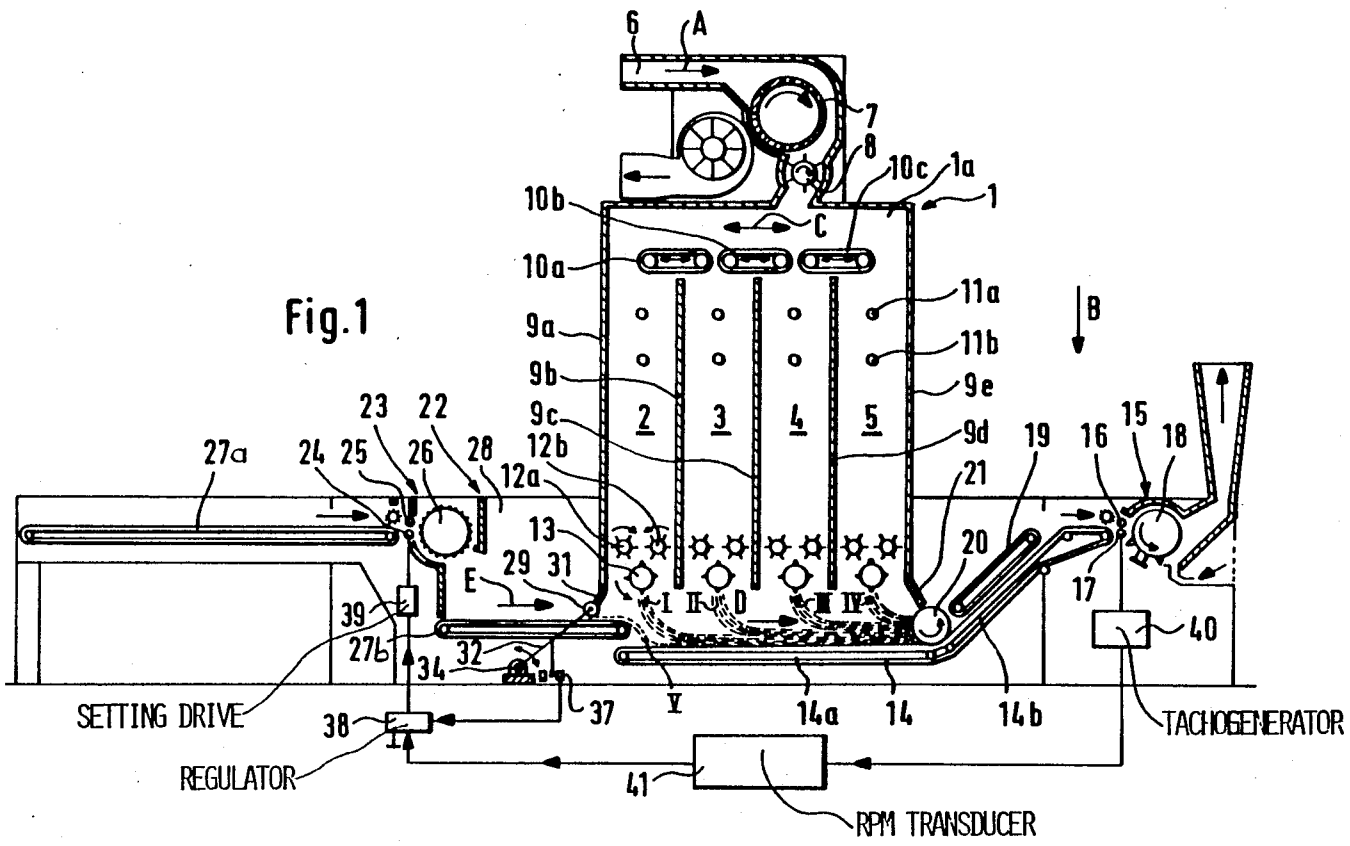
FIG. 1 is a schematic side elevational view of a preferred embodiment of the invention, including a block diagram.

Turning now to FIG. 1, there is illustrated therein a multiple mixer 1 including a plurality of vertical, serially arranged mixing hoppers 2, 3, 4 and 5 coupled to an overhead duct 6 through which fibers are delivered pneumatically in the direction of the arrow A. Between the duct 6 and the upper zone 1*a* of the mixer 1 there is arranged a screening drum 7 which separates the fibers from the conveying air. A dispenser/counter wheel 8 is arranged immediately downstream of the drum 7. Above the internal hopper walls 9*b*, 9*c* and 9*d*, in the space la there are arranged belt conveyors 10*a*, 10*b* and 10*c* which may be driven in two directions as indicated by the double-headed arrow C and which distribute the fiber tufts into the hoppers 2–5. Each hopper 2–5 has, on its lateral wall, two photocells 11*a* and 11*b* which prevent an overfill or an underfill of each hopper. The direction of conveyance of the conveyor belts 10*a*, 10*b* and 10*c* relative to the hoppers 2–5 may be controlled by the associated photocells 11*a*, 11*b*. The photocells 11*a*, 11*b* are connected to a non-illustrated drive motor for the material transport. Underneath the hoppers 2–5 there is arranged a common conveyor belt (mixing or blending belt) 14 which advances the fiber tufts deposited thereon in the direction of a stripping apparatus 15. In the zone of the lower end of each hopper 2–5 there are arranged cooperating removal rollers 12*a*, 12*b* and an opening roller 13. The useful fiber layers are designated at I–IV and the waste fiber layer—whose deposition onto the blending belt 14 will be described later—is designated at V. The arrow D indicates the conveying direction of the fiber layers I–V.

The useful fibers are introduced into the hoppers 2–5 from above, as indicated by the arrow B, approximately to the height of the photocells. As soon a the fiber level drops below the lower photocells 11*b*, a replenishment from the top takes place. Fiber material from all four hoppers 2–5 is simultaneously and continuously withdrawn and carried away by the blending conveyor belt 14 on which thus four superposed useful fiber layers I–IV are formed from the fiber material discharged from the respective hoppers 2–5. The hoppers 2–5 operate preferably in a continuous manner. The four-fold blended fiber material discharged by the mixer 1 is, by means of the blending belt 14, admitted to the common ablating apparatus (such as a cleaner) 15 having feed rollers 16, 17 and an opening roller 18. The driven blending conveyor belt (collecting belt) 14 is at the outlet of the mixer 1 deflected obliquely upwardly towards the cleaner apparatus 15; that is, the zone 14*b* of the conveyor belt 14, situated externally and downstream of the mixer 1 extends up to the feed rollers 16, 17 which form part of the cleaner 15. Between the blender 1 and the cleaner 15, above the length portion 14*b* of the blending belt 14 there is arranged a conveyor belt 19 for guiding and densifying the fiber material composed of layers I–V, in cooperation with the belt length portion 14*b*. At the outlet of the blender 1, above the conveyor belt 14, approximately in the zone below the wall 9*e* of the blender 1 there is arranged a roller 20 which is sealed against the wall 9*e* by means of an elastic seal 21 made, for example, of rubber or similar material and which serves to deflect upwardly the upper flight of the blending conveyor belt 14 and to compress the superposed fiber layers I–IV.

Upstream of the blending conveyor belt 14 there is arranged a waste fiber feeder generally designated at 22. It comprises an opener assembly 23 which has feed rollers 24 and 25 as well as an opening roller 26 and an input conveyor 27*a* supplying material to the opening assembly 23. The opening assembly 23 throws the opened waste fiber on a waste fiber feed conveyor 27*b* which constitutes the bottom of a collecting chamber 28. The direction of conveyance of the waste fibers on the feed conveyor 27*b* is designated with the arrow E. The feed conveyor belt 27*b* has a downstream end which extends over the upstream end of a length portion 14*a* of the blending conveyor belt 14.

Also referring to FIGS. 2 and 3, above the feed conveyor belt 27*b* there is arranged a roller 29 which cooperates with a counterroller 30 situated below the conveying reach (upper reach) of the conveyor 27*b*. Between the wall 9*a* of the blender apparatus 1 and the roller 29 there is disposed an elastic seal 31 which may be made of rubber or similar material. The roller 29 has at its axial ends two stub shaft 29*a* and 29*b* engaged by respective support arms 32 and 33 which, at their other ends, are pivotally supported in bearings 34 and 35. The roller 29 lies on the upper surface of the waste fiber feed conveyor 27*b* by its own weight and presses down on the waste fiber layer to thus form a fiber lap from the loose tuft material. The pivotal arms 32, 33 are swingable in the direction illustrated by the arrows F and G.

Figure 2:
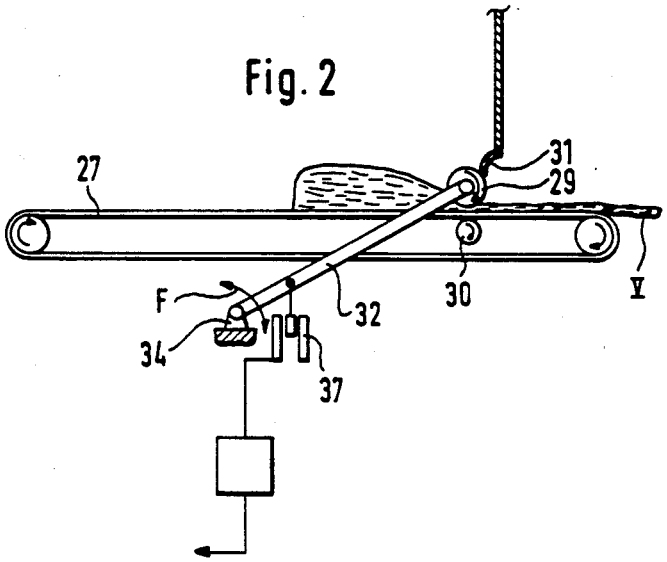
FIG. 2 is a schematic side elevational view showing further details of the preferred embodiment.
Figure 3:
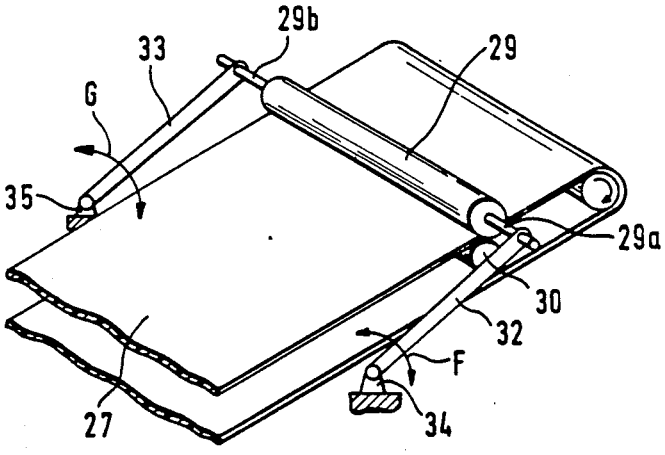
FIG. 3 is a schematic perspective view of several components of the preferred embodiment shown in FIG. 2.

As shown in FIGS. 1 and 2, the pivotal arms 34 and 35 are each associated with a separate measuring member, for example, an inductive path sensor 37 (only one shown). By virtue of this arrangement the roller 29 also serves as a measuring roller which senses thickness variations of the waste fiber lap supported on and advanced by the feed conveyor 27*b*. Thus, the roller 29 compresses (densifies) the fiber material into a thinner fiber lap V which is transferred onto the conveyor belt 14 and, subsequently, useful fiber layers I–IV are deposited on the top of the waste fiber layer V.

Reverting once again to FIG. 1, the measuring members 37 (only one shown) are each connected to a setting drive 39 of the feed roller 24 with the intermediary of a regulator 38. With the feed roller 17 of the cleaning apparatus 15 there is associated an rpm-measuring device 40 such as a tachogenerator which is connected through an rpm transducer 41 with the regulator 38 to apply a voltage thereto, representing the rpm of the feed roller 17.

The non-illustrated drives for the conveyor belts 14, 19, 27*a*, 27*b* and for the feed devices 16, 17; 24 and 25 for the cleaning apparatus 15 and, respectively, the opener 23 are synchronized with one another, for example, by electric synchronizing circuits. In this manner, a speed increase or speed decrease of the conveyor belts and the rollers are coordinated with one another. The increase and decrease of velocities may be effected in a proportionate manner. It is also feasible to set speed differences between the individual conveyor belts 14, 19, 27*a* and 27*b* and/or the feeding devices 16, 17; 24, 25 for the opener assembly 23 and the cleaner apparatus 15.

The present disclosure relates to subject matter contained in Federal Republic of Germany Patent Application P 37 40 616.7 (filed Dec. 1st, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of blending textile fibers, comprising the following consecutive steps:

(a) depositing a layer of waste fibers on a moving conveyor;

(b) depositing, in succession, a plurality of layers of useful fibers on the layer of waste fibers from a plurality of fiber hoppers arranged spaced in a direction of travel of the moving conveyor, whereby on said moving conveyor a fiber layer stack is formed, constituted by a lowermost waste fiber layer and a plurality of superposed useful fiber layers arranged on said waste fiber layer; and (c) simultaneously ablating all said layers by simultaneously removing the fibers therefrom.

2. A textile fiber blending apparatus comprising (a) a blending conveyor having a direction of travel, an upstream end and a downstream end as viewed in said direction of travel;

(b) a waste fiber feeder having a discharge means for discharging waste fiber on the upstream end of the blending conveyor for forming a waste-fiber layer thereon;

(c) a useful-fiber mixer having a plurality of fiber hoppers, each having a top portion, a bottom portion and a discharge opening at said bottom portion; the discharge openings being arranged above said blending conveyor, downstream of said discharge means of said waste fiber feeder and each depositing, in succession, a layer of useful fibers, whereby on the conveyor a fiber layer stack is formed, constituted by a lowermost waste fiber layer deposited by said waste-fiber feeder and a plurality of superposed useful-fiber layers; and (d) a fiber removing device arranged at the downstream end of said blending conveyor for receiving the fiber layer stack therefrom; said fiber removing device including an opening roller for ablating said fiber layer stack by removing fibers simultaneously from all the fiber layers.

3. An apparatus as defined in claim 2, further comprising a roller arranged downstream of said mixer pressing down on said blending conveyor for compressing fiber layer stack.

4. An apparatus as defined in claim 2, wherein said blending conveyor comprises a blending conveyor belt.

5. An apparatus as defined in claim 2, further comprising a guiding and compressing conveyor belt situated between said mixer and said fiber removing device and cooperating with a length portion of said blending conveyor for guiding and compressing the fiber layer stack.

6. An apparatus as defined in claim 2, further comprising a feed roller arranged upstream of said opening roller and cooperating with the discharge end of said blending conveyor for advancing the fiber layer stack to said opening roller.

7. A textile fiber blending apparatus comprising (a) a blending conveyor having a direction of travel, an upstream end and a downstream end as viewed in said direction of travel;

(b) a waste fiber feeder having a discharge means for discharging waste fiber on the upstream end of the blending conveyor for forming a waste-fiber layer thereon; said discharge means including a feed conveyor belt having a discharge end from which waste fiber is deposited on the upstream end of said blending conveyor and a roller pressing down on said feed conveyor belt for compressing the waste-fiber layer thereof for forming a waste-fiber lap prior to a deposition thereof on said blending conveyor;

(c) a useful-fiber mixer having a plurality of fiber hoppers, each having a top portion, a bottom portion and a discharge opening at said bottom portion; the discharge openings being arranged above said blending conveyor, downstream of said discharge means of said waste fiber feeder and each depositing, in succession, a layer of useful fibers, whereby on the conveyor a fiber layer stack is formed, constituted by a lowermost waste fiber layer deposited by said waste-fiber feeder and a plurality of superposed useful-fiber layers; and (d) a fiber removing device arranged at the downstream end of said blending conveyor for receiving the fiber layer stack therefrom; said fiber removing device including means for ablating said fiber layer stack by removing fibers simultaneously from all the fiber layers.

8. An apparatus as defined in claim 7, further comprising a counterroller cooperating with said roller and being situated underneath said feed conveyor belt.

9. An apparatus as defined in claim 7, wherein said mixer has a wall defining an inlet through which said feed conveyor belt passes; further comprising an elastic seal providing a seal between said roller and said wall.

10. An apparatus as defined in claim 7, further comprising pivot arms for swingably supporting said roller at opposite ends thereof; said pivot arms being held in respective support bearings.

11. An apparatus as defined in claim 10, further comprising sensor means coupled to at least one of said pivot arms for generating signals representing excursions of said roller from said feed conveyor belt.

12. An apparatus as defined in claim 11, further wherein said waste-fiber feeder includes a feed roller for advancing waste-fiber material; further comprising a regulator connected to said sensor means and said feed roller for regulating the rpm of said feed roller as a function of the signals generated by said sensor means.

13. An apparatus as defined in claim 12, wherein said fiber removing device has a feed roller for advancing the fiber layer stack from the downstream end of said blending conveyor; further comprising an rpm sensor connected to said feed roller of said fiber removing device and said regulator for controlling the rpm of said feed roller of said waste-fiber feeder as a function of the rpm of the feed roller of said fiber removing device.

14. An apparatus as defined in claim 7, wherein said roller is a first roller; further comprising a second roller arranged downstream of said mixer pressing down on said blending conveyor for compressing fiber layer stack.

15. An apparatus as defined in claim 7, wherein said blending conveyor comprises a blending conveyor belt.

16. An apparatus as defined in claim 7, further comprising a guiding and compressing conveyor belt situated between said mixer and said fiber removing device and cooperating with a length portion of said blending conveyor for guiding and compressing the fiber layer stack.

* * * * *